United States Patent [19]

Jakob

[11] Patent Number: 4,946,307

[45] Date of Patent: Aug. 7, 1990

[54] ASPHALT PAVEMENT RECYCLING APPARATUS

[75] Inventor: Herbert E. Jakob, Taylors, S.C.

[73] Assignee: Astec Industries, Inc., Chattanooga, Tenn.

[21] Appl. No.: 394,373

[22] Filed: Aug. 15, 1989

[51] Int. Cl.[5] ..... E01C 23/12

[52] U.S. Cl. ..... 404/91; 404/92; 404/90

[58] Field of Search ..... 404/90–92, 404/84, 75, 81; 299/39, 64

[56] References Cited

U.S. PATENT DOCUMENTS

| | | | |
|---|---|---|---|
| 2,201,493 | 5/1940 | Jorgensen | 404/92 |
| 3,843,274 | 10/1974 | Gutman et al. | 404/91 |
| 4,011,023 | 3/1977 | Cutler | 404/91 |
| 4,193,636 | 3/1980 | Jakob | 404/90 |
| 4,317,642 | 3/1982 | Wirtgen | 404/91 |
| 4,723,867 | 2/1988 | Wirtgen | 404/90 |
| 4,826,352 | 5/1989 | Wirtgen | 404/90 |

OTHER PUBLICATIONS

"Cold In-Place Recycling Across America"; Asphalt Recycling and Reclaiming Association; 6 pages; 1988.

*Primary Examiner*—Bruce M. Kisliuk

*Attorney, Agent, or Firm*—Bell, Seltzer, Park & Gibson

[57] ABSTRACT

An apparatus is disclosed for the cold, in-place recycling of asphalt paving of an asphalt roadway. The apparatus is self-propelled, and it includes a cylindrical milling drum mounted at a medial location along its longitudinal length and which serves to remove a thickness of the asphalt paving and break the same into particles as the apparatus moves forwardly along the roadway. The particles are lifted to a separating screen which is positioned forwardly of the drum, and the particles are thereby separated into a first portion of relatively small particles suitable for recycling and a second portion of oversized particles. The first portion is delivered to the rear end of the apparatus where it is mixed with a suitable liquid additive, and then discharged onto the roadway. A following paver then forms the discharged material into new paving. The second portion of oversized particles is discharged onto the roadway at a location in front of the milling drum. Thus the milling durm again contacts the second portion upon forward mavement of the apparatus, and the durm acts to further crush the particles and cause them to be recycled through the apparatus.

12 Claims, 2 Drawing Sheets

ASPHALT PAVEMENT RECYCLING APPARATUS

BACKGROUND OF THE INVENTION

The present invention relates to a self-propelled apparatus for removing a thickness of asphalt paving from an asphalt roadway and for reprocessing the removed asphalt so as to permit the recycling thereof.

Deteriorating asphalt roadways have in the past been rehabilitated by a process wherein the top layer of the asphalt roadway is removed by a drum type milling machine which is advanced along the roadway. The removed asphalt is then trucked to a reprocessing plant where the removed asphalt is usually blended with new aggregate and hot liquid asphalt in a rotary heater, to form a new asphalt paving material. This new material is then trucked back to the roadway while hot and laid on the roadway by a conventional paver.

As an alternative to the above process, a process has recently been developed which involves the cold, in-place recycling of asphalt, and which substantially reduces the transportation and heat energy costs associated with the above described process. This cold process has heretofore been carried out by a complex apparatus composed of a train of three separate roadway units positioned in tandem. The first unit includes a drum milling cutter for removing the top layer of the asphalt surface. The second unit receives the removed material on an inlet conveyor and has a vibratory screen for separating the material by size, with the relative fine portion dropping onto a discharge conveyor and the oversize portion being directed into a crusher and returned by a conveyor back to the inlet conveyor for recirculation through the vibratory screen. The final unit receives the proper, i.e. fine, material on a weigh conveyor, and a controlled amount of liquid asphalt or asphalt emulsion is added based upon the weight of the material. The mixture then passes through a pugmill type mixer and is discharged onto the roadway. A conventional paver follows the train, and forms the discharged material into pavement.

As will be apparent, the above described apparatus for the cold, in-place recycling of asphalt is structurally complex and expensive. More particularly, the train of roadway units incorporates a large number of separate conveyors, which are expensive and require separate maintenance. Also, the train of roadway units is large and cumbersome, and it cannot back up.

It is accordingly an object of the present invention to provide an apparatus for performing the cold, in place recycling of asphalt pavement which substantially avoids the limitations and disadvantages of the presently employed apparatus as described above.

It is a more specific object of the present invention to provide an apparatus of the described type which comprises a single roadway unit, and which is designed to efficiently perform all of the functions of the presently employed train of roadway units.

SUMMARY OF THE INVENTION

These and other objects and advantages of the present invention are achieve in the embodiment illustrated herein by the provision of a self-propelled roadway apparatus which comprises a frame having longitudinally separated front and rear ends, roadway engaging wheel means mounted to said front and rear ends of the frame, and power means mounted to the frame and operatively connected to the wheel means for propelling the apparatus along the roadway. A cylindrical milling drum having spaced cutting elements thereon is mounted to the frame at a medial location along the longitudinal length thereof and for rotation about a transverse axis, and drive means is provided for rotating the milling drum to remove a thickness of the asphalt paving and break the same into particles as the apparatus moves forwardly along the roadway. Particle processing means is mounted to the frame for receiving the asphalt particles removed by said milling drum and separating the same into a first portion of relatively small particles suitable for recycling and a second portion of oversized particles. The first portion is delivered to a rear discharge outlet located adjacent the rear end of the frame and the second portion is delivered to a forward discharge outlet which is located adjacent the front end of the frame. The second portion is thereby delivered onto the roadway forwardly of and in alignment with said milling drum, such that the milling drum again contacts the second portion upon forward movement of the apparatus and the second portion is thus again subjected to the processing of the apparatus.

BRIEF DESCRIPTION OF THE DRAWINGS

Some of the objects and advantages of the present invention having been stated, others will appear as the description proceeds, when taken in conjunction with the accompanying somewhat schematic drawings, in which.

BRIEF DESCRIPTION OF THE PREFERRED EMBODIMENT

Figure 1:
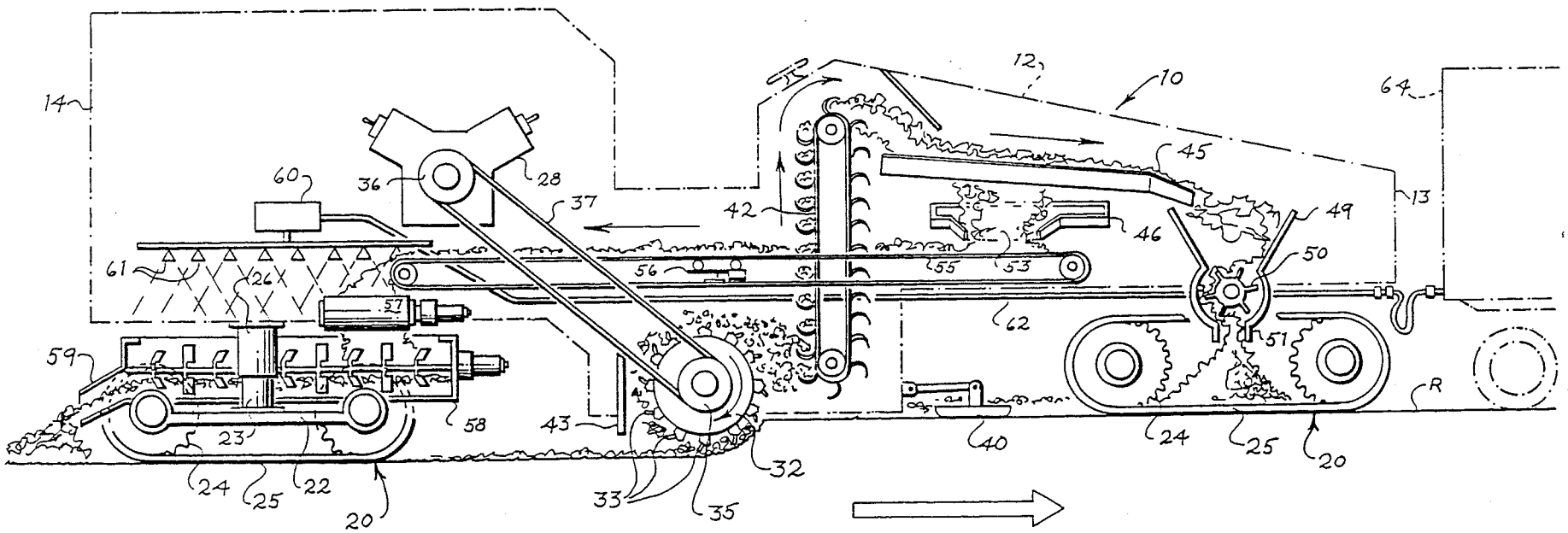
FIG. 1 is a side elevation view of an apparatus which embodies the features of the present invention.
Figure 2:
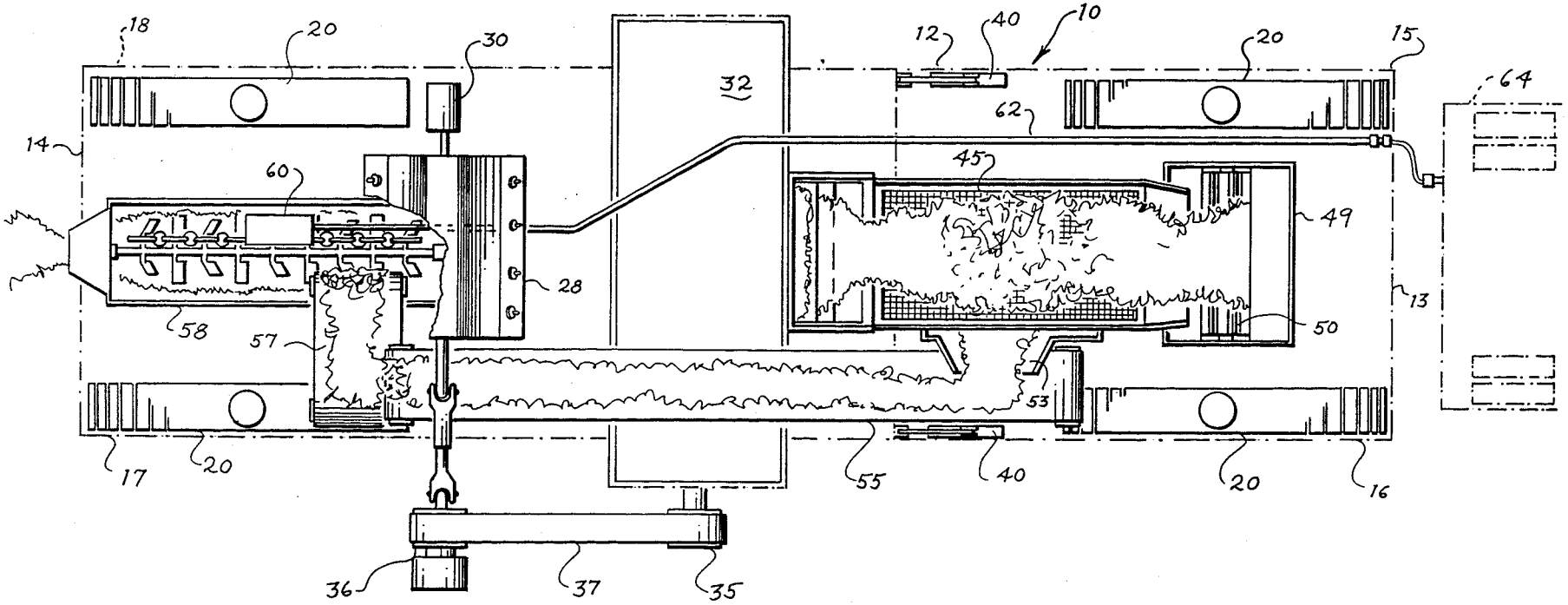
FIG. 2 is a top plan view of the apparatus shown in FIG. 1.

Referring more particularly to the drawings, an apparatus embodying the features of the present invention is indicated generally at 10. The apparatus 10 comprises a central frame 12 which is indicated by the dash dot lines. The frame is generally rectangular in outline, and it defines a front end 13, a rear end 14, and four corners 15, 16, 17 and 18. A wheel member 10 is positioned at each of the four corners for moveably supporting the apparatus upon a roadway R.

The wheel members 20 are of generally conventional construction, and each comprises a frame 22 supporting a lower sleeve 23, spaced sprockets 24 carrying an endless trackway 25, and a hydraulic motor (not shown) which serves to rotate the sprockets and the trackway to thereby propel the apparatus in either direction along the roadway. The sleeve 23 of each wheel is slidably received in an upper sleeve 26 which is fixedly mounted to the frame 12 of the apparatus, and means are provided for adjustably interconnecting each lower sleeve 23 with its upper sleeve 26 such that each wheel member 20 may be independently raised or lowered with respect to the frame 12. This interconnecting means is conventional and is thus not illustrated herein, and it may for example include a hydraulic cylinder mounted inside the two sleeves.

A prime mover, such as an internal combustion engine 28, is mounted to the frame 12 of the apparatus 10. The engine powers one or more hydraulic pumps 30 which are part of a central hydraulic system and which in turn power the hydraulic motors associated with the wheel members 20 so as to propel the apparatus along the roadway and raise and lower the frame 12 with respect to the wheel members 20. The central hydraulic system also powers several other powered components of the apparatus as described below.

The apparatus 10 mounts a cylindrical milling drum 32 having spaced cutting elements 33 thereon, with the drum 32 being mounted to the frame 12 at a medial location along the longitudinal length thereof and for rotation about a transverse horizontal axis. The drum 32 is of a type well known in the art, such as disclosed in the applicant's prior U.S. Pat. No. 4,193,636. The drum 32 is rotatably driven by a drive system which includes a pulley 35 coaxially mounted to the drum 32, an aligned pulley 36 mounted to the output of the engine 28, and a multiple drive belt transmission 37 interconnecting the two pulleys 35, 36. As illustrated, the engine 28 acts to rotate the drum 32 in a forward direction with respect the forward movement of the apparatus. Thus the milling drum cuts downwardly onto the surface of the roadway, which has been found to provide better control of the resulting particle size of the asphalt.

The elevation of the milling drum 32, and thus the depth of its cut, are controlled by a conventional elevation and slope control system, which includes a ski 40 which is pivotably mounted to each side of the frame 12 immediately ahead of the milling drum 32. Each ski 40 thus rides on the original roadway surface, ahead of the drum 32, and its pivotal movements activate a valve (not shown) which in turn controls the elevation of the wheel members 20 with respect to the frame 12.

A vertical bucket type conveyor 42 is positioned forwardly of the milling drum 32, for receiving the asphalt particles which are removed by the drum. The frame 12 of the apparatus may also include a suitable guide plate 43 which partially encloses the drum 32 for directing the removed particles onto the conveyor 42. The conveyor 42 is powered by the central hydraulic system, and it serves to lift the particles upwardly onto a vibrating screen 45. The screen 45 is mounted to the frame 12 by means of springs (not shown) so as to permit vibrating movement, and it is also powered by the central hydraulic system. The screen 45 has openings of predetermined size, which by design permit a first portion of the particles, and which are of a relatively fine size suitable for recycling, to drop therethrough onto an underlying tray member 46. Also, the screen 45 is inclined downwardly in the forward direction, and so that a second portion of the particles, i.e. the oversize particles which are too large to pass through the openings, move forwardly to the forward lowermost end of the screen where they are discharged downwardly into a guide passageway 49 which includes a rotary crusher 50. The crusher 50 is powered by the central hydraulic system, and it acts to reduce the size of the particles and to then discharge the crushed particles onto the roadway R through a forward discharge outlet 51 of the guide passageway 49. The forward discharge outlet 51 is located adjacent the front end 13 of the frame 12 and so as to deliver the second portion of the particles onto the roadway R forwardly of and in alignment with the milling drum 32, and such that the milling drum again contacts the second portion upon forward movement of the apparatus.

The tray member 46 which underlies the screen 45 and which receives the first portion of the particles, is laterally inclined so as to define a lower discharge end 53. A longitudinal conveyor 55, which is powered by the central hydraulic system, is positioned to receive the first portion of the particles from the discharge end 53 of the tray member 46 and to convey the same rearwardly along a path which extends above and rearwardly beyond the milling drum 32. A load cell 56 is operatively connected to the conveyor 55 for the purposes described below.

The discharge end of the conveyor 55 is positioned above a short transverse conveyor 57, and the transverse conveyor is positioned to drop the material into a pugmill type mixer 58. The mixer 58 is positioned adjacent the rear end 14 of the apparatus, and the rear end of the mixer includes a rear discharge outlet 59 through which the mixed material is deposited onto the roadway. A liquid metering system 60 which comprises a plurality of outlets 61 is also provided for metering a predetermined quantity of a liquid additive onto the first portion in an amount proportional to the mass flow rate thereof. More particularly, the output of the load cell 56 is fed to a metering control system, by which the mass flow rate of the particles on the conveyor is calculated, and the amount of liquid additive which is metered onto the first portion is controlled so as to be proportional to the mass flow rate. The liquid additive may be piped to the apparatus through a line 62 which may be coupled to a separate vehicle 64 as indicated in the drawings, and the additive typically comprises heated liquid asphalt or an asphalt emulsion.

In operation, the apparatus 10 is moved along the roadway R under its own power and at a predetermined speed, with the milling drum 32 being forwardly rotated so as to remove a predetermined and controlled thickness of the asphalt paving and to break the removed asphalt into relatively small particles. The thickness and slope of the cut is controlled by the setting of the two skis 40.

The removed asphalt particles are delivered into the bucket conveyor 42 which conveys the material upwardly and onto the vibrating screen 45. The relatively fine portion of the material is separated by the screen and drops through the screen and onto the inclined tray member 46, and it then slides laterally across the tray member until it drops from the discharge end 53 of the tray member onto the longitudinal conveyor 55. The load cell 56 weighs the material as it is carried rearwardly over the milling drum 32, and the material is delivered into the mixer 58 at the rear end 14 of the apparatus. The metering outlets 61 which are positioned above the mixer 58 add an appropriate quantity of liquid additive to the material, and after mixing, the mixer discharges the mixed material onto the surface of the roadway through the rear discharge outlet 59. This material may then be formed into pavement by a conventional paver which follows the apparatus.

The oversized portion of the removed asphalt particles is directed forwardly from the screen 45 so as to be discharged into the crusher 50, and the crushed material is then discharged onto the roadway surface through the forward discharge outlet 51 so as to be in front of the milling drum 32. As the apparatus moves forwardly, the milling drum 32 acts to further crush the material and to return it for reprocessing in the apparatus. Also, since the drum again crushes the material, it may be possible in some applications to eliminate the separate crusher 50 as illustrated, since the action of the milling drum 32 will be sufficient to adequately reduce the particles to the desired size.

It will be noted that the size separation and crushing operations are both conducted in front of the milling drum 32, which permits the oversized portion to be simply dropped onto the roadway for reprocessing by the milling drum as the apparatus moves along the roadway. Also, any spillage is automatically picked up and reprocessed by the drum.

In the drawings and specification, there has been set forth a preferred embodiment of the invention, and although specific terms are employed, they are used in a generic and descriptive sense only and not for purposes of limitation.

That which is claimed is:

1. A self-propelled apparatus for removing a thickness of asphalt paving from an asphalt roadway and reprocessing the removed asphalt so as to permit the recycling thereof, and comprising a frame having longitudinally separated front and rear ends, roadway engaging wheel means mounted to said front and rear ends of said frame, power means mounted to said frame and operatively connected to said wheel means for propelling the apparatus along the roadway, pavement milling means mounted to said frame at a medial location along the longitudinal length thereof and for rotation about a transverse axis, and drive means for rotating said milling means to remove a thickness of the asphalt paving and break the same into particles as the apparatus moves forwardly along the roadway, particle processing means mounted to said frame for receiving the asphalt particles removed by said milling means and separating the same into a first portion of relatively small particles suitable for recycling and a second portion of oversized particles, and for delivering said first portion to a rear discharge outlet located adjacent said rear end of said frame and delivering said second portion to a forward discharge outlet located adjacent said front end of said frame and so that said second portion is delivered onto the roadway forwardly of and in alignment with said milling means and the milling means again contacts said second portion upon forward movement of the apparatus.

2. The apparatus as defined in claim 1 wherein said particle processing means further comprises means for determining the mass flow weight of the first portion of the particles, means for metering a quantity of liquid additive onto the first portion in an amount proportional to the mass flow rate thereof, and mixer means for mixing said first portion and said liquid additive and then discharging the mixture onto the roadway through said rear discharge outlet.

3. The apparatus as defined in claim 1 wherein said milling means comprises a cylindrical milling drum having spaced cutting elements thereon, and said drive means is operatively connected to said power means and acts to rotate said drum in a forward direction with respect to the forward movement of said apparatus.

4. The apparatus as defined in claim 1 wherein said frame is generally rectangular in outline to define four corners, and wherein said roadway engaging wheel means comprises a supporting wheel member positioned at each of said four corners, and means for adjustably interconnecting each of the supporting wheel members to said frame such that each wheel member may be selectively and independently raised or lowered with respect to said frame.

5. The apparatus as defined in claim 1 wherein said particle processing means comprises a bucket elevator positioned forwardly of said milling means for receiving the asphalt particles removed by said milling means and conveying the same upwardly, and a vibrating screen positioned to receive the particles from said bucket conveyor, with said vibrating screen having openings therein of a size for permitting said first portion of said particles to pass downwardly therethrough, while said second portion of said particles does not pass through said openings.

6. The apparatus as defined in claim 5 wherein said vibrating screen is inclined so as to define a lower end, and so that the second portion of said particles moves along said screen and is discharged from said lower end.

7. The apparatus as defined in claim 6 wherein said particle processing means further comprises a tray member positioned below said screen for receiving said first portion, with said tray member being inclined so as to define a lower end, and so that the first portion moves along said tray member and is discharged form said lower end of said tray member.

8. The apparatus as defined in claim 7 wherein said particle processing means further comprises a longitudinal conveyor positioned to receive the first portion from said lower end of said tray member and with said longitudinal conveyor extending rearwardly above said milling means.

9. The apparatus as defined in claim 8 further comprising passageway means for permitting the second portion of said particles to pass from said lower end of said screen to said forward discharge outlet, and wherein said passageway means includes means positioned between said lower end of said screen and said forward discharge outlet for crushing the second portion of said particles prior to being deposited on said roadway.

10. A self-propelled apparatus for removing a thickness of asphalt paving from an asphalt roadway and reprocessing the removed asphalt so as to permit the recycling thereof, and comprising a frame having longitudinally separated front and rear ends, roadway engaging wheel means mounted to said front and rear ends of said frame, power means mounted to said frame and operatively connected to said wheel means for propelling the apparatus along the roadway, pavement milling means comprising a cylindrical milling drum having spaced cutting elements thereon and mounted to said frame at a medial location along the longitudinal length thereof and for rotation about a transverse axis, and drive means for rotating said milling drum to remove a thickness of the asphalt paving and break the same into particles as the apparatus moves forwardly along the roadway, bucket elevator means positioned forwardly of said drum for receiving the asphalt particles removed by said drum and conveying the same upwardly, a vibrating screen positioned forwardly of said bucket elevator means for receiving the particles from said bucket elevator means, and with said vibrating screen being inclined so that the most forward end of said screen is lower than the remainder of said screen, and with said vibrating screen having openings therein of a size for permitting a first portion of said particles of relatively small size to pass downwardly therethrough, while a second portion of said particles of relatively large size moves longitudinally along said screen and is discharged from said forward end thereof, a tray member positioned below said screen for receiving said first portion of said particles, with said tray member being laterally inclined so that one lateral side edge portion of said tray member is lower than the remainder of said tray member and defines a lower discharge end, a longitudinal conveyor positioned for receiving said first portion from said discharge end of said tray member and conveying the same rearwardly to a discharge location adjacent said rear end of said frame, with said longitudinal conveyor extending rearwardly beyond and above said milling drum, means for metering a liquid additive onto the first portion in an amount proportional to the mass flow rate thereof, mixer means mounted to receive said first portion from said longitudinal conveyor and to receive the metered liquid additive for mixing the same and then discharging the mixture onto the roadway at a rear discharge outlet, and passageway means for permitting the second portion to drop from said forward end of said screen onto the roadway at a forward discharge outlet located forwardly of and in alignment with said milling drum, whereby the milling drum again contacts said second portion upon forward movement of the apparatus.

11. The apparatus as defined in claim 10 wherein said passageway means includes means for crushing the second portion of said particles passing therethrough and prior to being dropped onto the roadway.

12. The apparatus as defined in claim 10 wherein said drive means comprises a power transmission operatively connected between said power means and said drum, and said drive means acts to rotate said drum in a forward direction with respect to the forward movement of said apparatus.

* * * * *